US007217444B2

(12) United States Patent
Hays et al.

(10) Patent No.: US 7,217,444 B2
(45) Date of Patent: May 15, 2007

(54) PROCESS FOR ELECTROSTATIC POWDER COATING AN ARTICLE USING TRIBOELECTRICALLY CHARGED POWDER WITH AIR JET ASSIST

(75) Inventors: Dan A. Hays, Fairport, NY (US); Jack T. Lestrange, Macedon, NY (US)

(73) Assignee: Xerox Corporation, Stamford, CT (US)

( * ) Notice: Subject to any disclaimer, the term of this patent is extended or adjusted under 35 U.S.C. 154(b) by 434 days.

(21) Appl. No.: 10/880,219

(22) Filed: Jun. 29, 2004

(65) Prior Publication Data

US 2005/0287306 A1 Dec. 29, 2005

(51) Int. Cl.
*B05D 1/28* (2006.01)

(52) U.S. Cl. ..... 427/458; 427/475; 427/485

(58) Field of Classification Search ..... 427/458, 427/475, 485

See application file for complete search history.

(56) References Cited

U.S. PATENT DOCUMENTS 3,549,403 A * 12/1970 Barbehenn et al. ..... 427/471
3,680,779 A * 8/1972 Reilly ..... 239/3
4,330,567 A 5/1982 Gillette
4,505,573 A * 3/1985 Brewington et al. ..... 399/284
4,805,069 A 2/1989 Nagasaka et al.
5,078,084 A 1/1992 Shutic et al.
5,276,488 A 1/1994 Schmidlin
5,504,563 A 4/1996 Hays
5,518,546 A 5/1996 Williams et al.
5,743,958 A 4/1998 Shutic
6,342,273 B1 * 1/2002 Handels et al. ..... 427/475
2002/0127332 A1 9/2002 Bertellotti
2002/0160123 A1 10/2002 Fortuyn et al.
2003/0003813 A1 1/2003 Irwin et al.

* cited by examiner

*Primary Examiner*—Fred J. Parker

(57) ABSTRACT

A system for electrostatic powder coating irregular shaped, three-dimensional articles with 10 μm average diameter powder particles. A supply of powder particles are triboelectrically charged and transported onto one or more donor rolls without the need from fluidization of the powder particles. The charged powder particles on the one or more donor rolls are metered to provide a uniform layer thereon. A combination of AC electric fields and/or air jet detach the powder particles from the one or more donor rolls and produce a powder cloud that is directed to the grounded article to be coated. A layer of powder particles coats the outer surface of the article, and the layer is subsequently cured to form a permanent and durable film on the article.

8 Claims, 4 Drawing Sheets

PROCESS FOR ELECTROSTATIC POWDER COATING AN ARTICLE USING TRIBOELECTRICALLY CHARGED POWDER WITH AIR JET ASSIST

BACKGROUND

An exemplary embodiment of this application relates to an electrostatic powder coating process and apparatus for coating an article with charged powder particles by forming a powder cloud with one or more air jets, so that the cloud of charged particles surrounds and coats the article. More particularly, the exemplary embodiment relates to an electrostatic powder coating process and apparatus for coating a grounded article with triboelectrically charged powder particles contained in a chamber, advancing the charged powder particles onto at least one rotatable donor roll, rotating the donor roll past an air jet whereat a combination of electric fields and/or air jets detach the charged powder particles from the donor roll to form a powder cloud that is directed to the grounded article.

The process of coating metal or conductive surfaces with dry powder coatings is well known. The process has been used since the mid 1950's. The initial applications of electrostatic powder coating involved the coating of pipe and electric motors. By utilizing the natural principle of opposite charges attract, this coating technology offered manufacturers an alternative to solvent-based paints. With the growing need to reduce air pollution from solvent-based paints, the demand for electrostatic powder coating has increased over the years. Although the cost of powder and liquid coatings is comparable, dry powder coating is advantaged because spray booths are easily cleaned, no solvents are used eliminating the need for air pollution control equipment, over spray can be collected for reuse, thicker film coatings can be obtained in a single application, and powder has no surface tension, so it will penetrate into small gaps precluded by liquid coatings.

Powder particles for powder coating apparatus are typically delivered to spray guns that electrically charge the expelled powder particles by means of ion corona discharge or triboelectric charging. The powder feed system for the spray guns generally requires fluidization of the powder particles. The powder generally does not contain surface flow additives to improve fluidization because the quality of powder coating film would be compromised during the oven-curing step. With this materials constraint, the powder coating industry generally uses powder particles having an average diameter of 30 to 40 μm, since particles of this size are easily fluidized. The fluidized powder particles are pneumatically transported to a triboelectric or ion charging spray gun for charging the powder and directing the cloud of powder particles to the article to be coated. For triboelectric spray guns, the powder collides with triboelectric-active materials placed in a tortuous path within the gun. For ion spray guns, a voltage of approximately 100 kV applied to a needle electrode generates a corona and the ions are captured on the powder particles in the powder cloud. However, to achieve higher coating quality with thinner layers, there is a need for an improved process and apparatus for powder coating articles with powder particles having an average diameter of approximately 10 μm. This requirement is particularly desired for top gloss coat in automobile coating.

There are many existing powder coating systems wherein a powder is air fluidized in a reservoir and pneumatically fed to a spray gun where the powder is charged. A combination of electrostatic and pneumatic forces transports the charged powder to the article to be coated. Electrostatic forces attract the charged powder to the article. The coated article is typically baked in an oven for approximately 10 minutes at about 400° F. The powder coating melts and flows into a durable film. Such typical powder coating systems are provided by, for example, Wagner International AG, Ransburg Corporation, Nordson Corporation, and Gema Volstatic AG.

U.S. Pat. No. 6,342,273 discloses an improvement over the typical powder coating processes and apparatus. In this reference, electrophotographic development system technology is described to triboelectric or induction charge powder paint particles for electric field transfer directly to flat substrates for subsequently curing, such as, a continuous or discontinuous band, sheet or web substrates. One substrate example was an unwound flat coil. According to a preferred embodiment, the powder paint particles are mixed with magnetic or non-magnetic carrier particles to obtain friction charging. Then the mixture is transported adjacent the substrate to be coated by a transport means, and the charged powder particles are extracted from the mixture and applied to the substrate by means of an electric field between the substrate and the means of transport. The advantage of such a process is that it is possible to apply powder particles having particle sizes between 5–30 μm. Unfortunately, such a process is limited to coating directly onto closely adjacent and confronting flat substrates in a manner similar to developing an electrostatic latent image on a photoreceptor in the field of electrophotography. Thus, the process of this patent cannot adequately coat three-dimensional articles, such as those articles needed in the industry for appliances, automobiles, and the like.

U.S. Pat. No. 5,518,546 discloses process and apparatus for applying electrostatically charged powder resin particles to a substrate to be coated by utilizing a fluidized bed for inductively charging the powder resin particles through a high voltage means disposed at one portion of the fluidized bed and a grounded electrode disposed in another portion of the fluidized bed, so that an electric field is created therebetween. Fluidizing air is applied to the powder resin particles to establish an electrostatically charged powder cloud within the fluidized bed, and then pneumatically conveying the charged powder particles from the fluidizing bed to a dispensing nozzle or gun for directing the charged powder particles onto the substrate. The coating on the substrate is subsequently fused or cured to form a permanent film thereon. The powder resin particles are mixed with at least one modifying agent that promotes charging of the mixed particles, but does not alter the melt or durability characteristics of the powder resin particles.

U.S. Pat. No. 5,078,084 discloses using a powder material for coating large objects, such as, vehicle bodies. An electrical charge is applied to sprayed powder which is directed toward grounded vehicle bodies to be coated by spray guns. The application of powder material onto the automotive or truck bodies is performed in a spray booth, so that over spray powder that is not deposited on the vehicle body can be collected. An exhaust system that creates a negative pressure in the spray booth aids in containment of the over spray powder and causes the over spray powder to be drawn into a powder collection and recovery system. The recovered powder is saved for reuse by the powder spray guns.

U.S. Pat. No. 5,743,958 discloses apparatus to collect and reuse over spray powder that contains a proportionately greater percentage of smaller particles or "fines" than virgin powder, since a greater percentage of larger particles have adhered to the object to be coated. The system for applying powder coating material onto large objects, such as, vehicle bodies, includes a powder spray booth, a powder kitchen containing a mixing hopper, and a number of feed hoppers, which receive the powder material from the powder kitchen and supply it to powder spray guns. The mixing hopper in the kitchen maintains the selected ratio of recovered over spray powder and virgin powder material.

U.S. Pat. No. 4,805,069 discloses an electrostatic powder painting apparatus including a powder charging apparatus therein. The powder painting apparatus has a pair of plasma electrodes disposed in an insulative tubular passage for transporting powder carried by gas. A DC voltage is intermittently applied between the plasma electrodes to form one space where mainly desired polarity ions exist that are drawn from the plasma electrodes and another space where mainly opposite polarity ions exist, thereby assuring stable and strong charging without adhesion and accumulation of powder to and on either one of the pair of plasma electrodes.

U.S. Pat. No. 4,330,567 discloses an electrostatic fluidizing bed coating apparatus for work pieces, especially those of continuous length, such as metal wires. The coating apparatus includes a housing with a planar horizontal porous support member therein defining a fluidization chamber in the housing above the porous support member and a plenum below it. Gas is introduced into the plenum for passage upwardly through the porous member to effect fluidization of particulate coating material in the chamber. A means is provided for ionizing the gas in the plenum to effect electrostatic charging of the fluidized coating material. An electrically conductive grid is mounted in the plenum between the porous support member and ionizing means and has means to control its electrical potential. The work piece is passed through the housing between the porous support member and the cloud control grid, so that the grid may be used to affect the deposition of powder upon the work piece.

U.S. Pat. No. 3,680,779 discloses an electrostatic powder sprayer for depositing powder material on an article to be coated. A metering roller at the bottom of a powder reservoir is rotated to dispense powder. A first circuit is connected to the metering roller and a conductor located between the article and the metering roller establishes a primary AC electric field to accelerate the powder from the metering roller. At least one electrode is spaced a greater distance from the metering roller than the conductor. A second circuit is connected between the metering roller and the electrode to establish an auxiliary electric field therebetween. The second circuit is provided to further control the movement of powder from the area of the primary electric field to the article, so that a more uniform powder is laid on the article and the amount of powder "fly around" is reduced.

U.S. Patent Application Publication No. 2002/0127332 discloses apparatus and method for applying powder to the interior surface of a hollow object. A powder discharge device having a powder discharge outlet is positioned within the hollow object and a stream of electrostatically charged powder is directed through the discharge outlet. The object is rotated, so that the stream of charged powder contacts the interior surface of the rotating object.

U.S. Patent Application Publication No. 2002/0160123 discloses a method for electrostatic powder coating or painting of non-conductive polymer surfaces by applying a conductive layer, such as a metal foil on the side opposite the non-conductive polymer surface to be painted, so as to provide sufficient conductivity to enable electrostatic powder painting thereof. With the conductive layer in place, the non-conductive article can be painted electrostatically. After painting, the conductive layer can be optionally removed without affecting the painted surface.

U.S. Patent Application Publication No. 2003/0003813 discloses metallic studs of a dynamoelectric machine that are coated with a powder resin to form an electrical insulator between the rotor and the studs. The powder coating is applied by several disclosed methods. In the preferred method, an electrostatic fluidized bed is provided and air is passed through the powder disposed in the bed to obtain a rolling boil of the powder. An applied high potential is provided in the air to produce free electrons that are passed through the powder. The stud is located in the powder cloud in the fluidized bed and as the powder is charged, the electrostatic potential enables the powder to be attracted to the studs. The powder coating on the stud is then cured. Instead of disposing the stud in a powder cloud, a spray gun may be utilized.

SUMMARY

It is an object of an exemplary embodiment of this application to provide an electrostatic powder coating process and apparatus for triboelectrically charging powder particles having an average diameter of about 10 μm, loading a uniform layer of the charged powder particles on a donor roll, and detaching the charged powder particles from the donor roll by means including an air jet to generate a cloud of charged powder particles for electrostatic attraction and coating of articles, such as, for example, appliances and automobiles.

In one aspect of the exemplary embodiment, there is provided a process for electrostatic powder coating of an article, comprising the steps of: triboelectrically charging powder particles contained in a chamber, said powder particles having an average diameter of about 10 μm; advancing said powder particles from said chamber onto at least one rotatable donor roll; metering said powder particles on said donor roll while the donor roll is being rotated to provide a uniform layer of powder particles thereon; providing means for detaching said powder particles from the at least one donor roll and forming a cloud of charged powder particles, said means for detaching including an air jet; directing said cloud of charged particles toward an article to be coated by said air jet; and grounding said article, so that said charged powder particles are attracted to and coat the outer surface of said article.

BRIEF DESCRIPTION OF THE DRAWINGS

An exemplary embodiment of this application will now be described, by way of example, with reference to the accompanying drawings, in which like reference numerals refer to like elements, and in which.

DESCRIPTION OF THE PREFERRED EMBODIMENT

Figure 1:
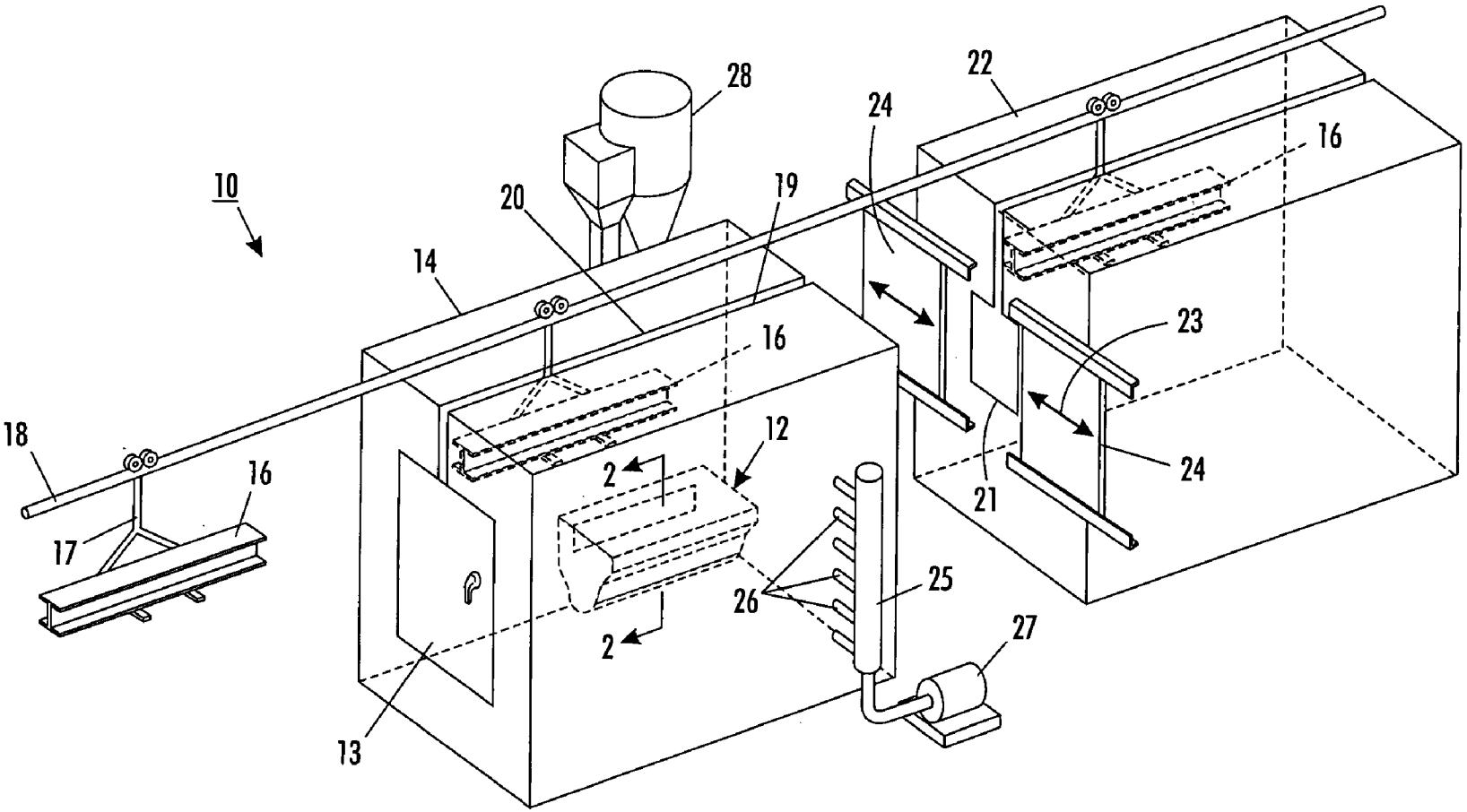
FIG. 1 is a schematic isometric view of an electrostatic powder coating system incorporating the powder coating process and apparatus of this application.

FIG. 1 schematically depicts the various components of an illustrative powder coating system 10, incorporating the electrostatic powder coating apparatus 12 of this application. Inasmuch as the art of electrostatic powder coating systems are well known, the operation of the system shown in FIG. 1 will be only briefly discussed.

The electrostatic powder coating system 10 shown in FIG. 1 includes a powder coating booth 14 that ensures that the powder cloud produced by the electrostatic powder cloud generating apparatus 12 is contained therein. The powder cloud generating apparatus 12 may contain one or more stationary or moving units for producing the powder cloud. Articles 16 to be coated, such as, for example, an I-beam, may be manually placed in the coating booth through the door 13 or, as illustrated, may be placed in the coating booth automatically by a conveyor or monorail 18 on movable supports 17. A slit 19 having a flexible seal 20 is provided in the top wall of the coating booth to accommodate the movable support carrying the article 16 to be coated while preventing the escape of the powder cloud. Once the article is coated with powder, it is removed through a back door (not shown) and transported into an oven 22 for curing through the opening 21 covered by sliding doors 24 moved in directions indicated by arrows 23. Instead of an oven, another curing enclosure (not shown) could be provided for low temperature curing, such as, for example, UV curing.

The coating booth 14 may be constructed with stainless steel or a non-metallic material. Cleaning air jets 26 interconnected between one side of the coating booth and a manifold 25 of an air compressor 27 are provided to enable clean up of the over spray powder in the coating booth. A cyclone-type powder extractor 28 connected to the coating booth may be activated to collect the unused powder in the coating booth for reuse. On all coating booths, manual or automatic, air velocities should be sufficient to prevent powder from escaping and causing contamination of the work area. In other words, there should be air streaming into the coating booth at every opening during a coating operation of at least 0.5 m/sec. Usually, the powder recovery system includes the air withdrawal or suction necessary to prevent powder from escaping from the coating booth.

Figure 2:
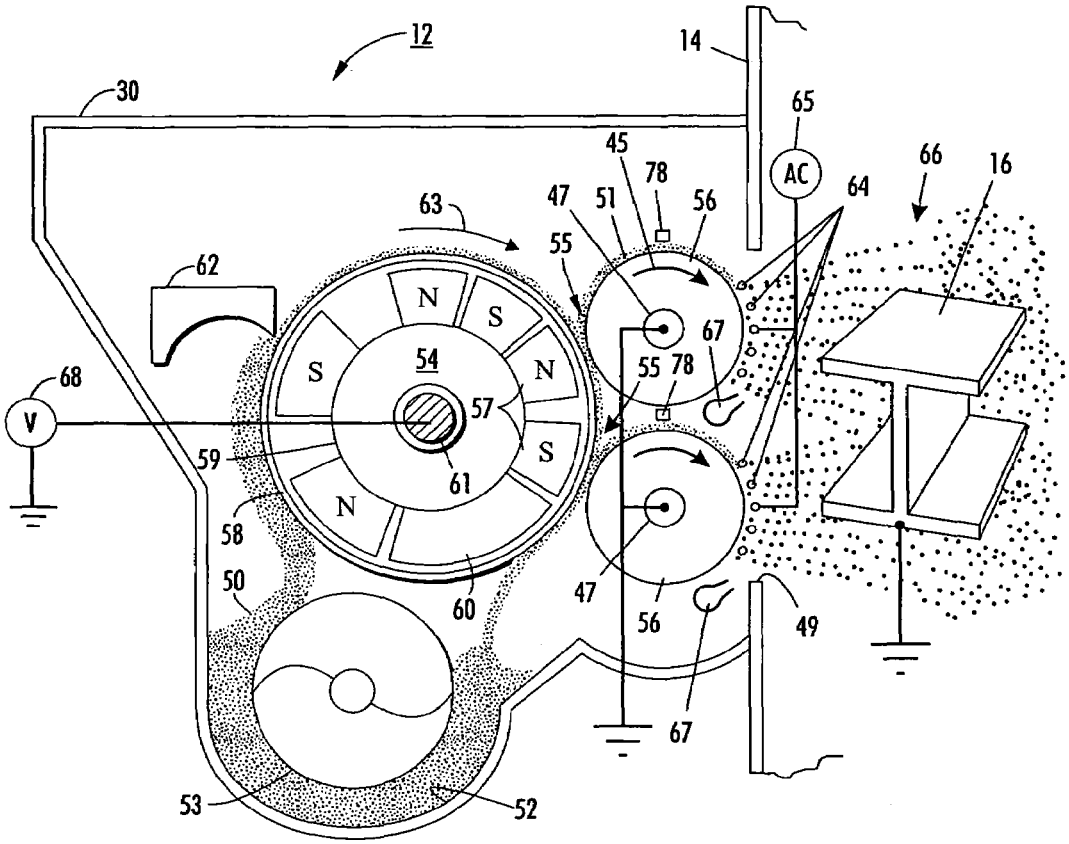
FIG. 2 is a schematic elevation view of the powder coating apparatus of this application shown in cross-section as viewed along line 2—2 in FIG. 1.

In FIG. 2, a schematic cross-sectional elevation view of the powder coating apparatus 12 is shown as viewed along line 2—2 in FIG. 1. The powder coating apparatus comprises a housing 30 containing a supply of powder material 50 in a lower section or sump 52 of the housing. The housing 30 is attached to the coating booth 14 with an aperture 49 therebetween. The powder material 50 comprises powder particles 51 and magnetic beads (not shown). The powder particles range in size from about 5 to 40 μm in diameter and are preferably about 10 μm. The magnetic beads range in size from about 30 to 300 μm in diameter and are preferably about 60 to 80 μm. The beads can have a partial surface coating of a polymer such as poly(methyl methacrylate) or polytetraflouroethylene and mixtures thereof for the purpose of controlling the triboelectric charging polarity and magnitude of the powder particles.

The housing sump 52 includes at least one auger 53, and preferably two, that is rotatably mounted therein and is rotated by any suitable drive means, such as, for example, an electric motor (not shown). The auger serves to disperse and mix the powder particles and magnetic beads, to transport the powder material to appropriate locations within the sump 52, and to agitate the powder material within the sump to triboelectrically charge the powder particles, so that they adhere to the magnetic beads.

A magnetic brush roll 54 transports powder material 50 from the sump 52 to the loading nips 55 of a pair of donor rolls 56. The donor rolls are parallel to each other and mounted for rotation about their respective parallel axes 47. The donor rolls may be identical or have different sizes. The donor rolls 56 are rotatably driven in the direction of arrows 45 by any suitable means, such as, for example, one or more electric motors (not shown). The donor rolls contact the magnetic brush roll 54 and provide loading nips 55 along the length of the donor rolls. A layer of powder material is sandwiched between the magnetic brush roll and the donor rolls.

Magnetic brushes are well known, so the construction of a magnetic brush roll need not be described in great detail. Briefly, the magnetic brush roll 54 comprises a rotatable tubular member or sleeve 58 within which is located a stationary magnetic cylinder 59 having a plurality of alternately polarized magnetic pole pieces 57 impressed around its outer surface. A non-magnetic member 60 is impressed among the magnetic poles on the magnetic cylinder 59 at a location downstream from the point of contact by the last or downstream donor roll, in order to remove the powder material 50 from the magnetic brush roll. As the tubular member 58 of the magnetic brush roll 54 rotates in the direction of arrow 63, magnetic beads of the powder material, together with powder particles adhering triboelectrically thereto, are attracted to the magnetic brush roll except in a region adjacent the non-magnetic member 60.

Thus, the powder material 50 is conveyed from the sump 52 to electrically grounded donor rolls 56 through loading nips 55 whereat the powder particles are extracted from the magnetic beads and deposited on the donor rolls by an AC/DC electrical bias on the rotating tubular member 58 through voltage source 68 connected to the axially located shaft 61 of the magnetic cylinder 59. Shaft 61 is parallel to the donor roll axes 47. As the magnetic brush roll continues to rotate passed the last donor roll, the magnetic beads, which are partially denuded of powder particles, encounter the non-magnetic member 60, causing the powder material, though having a reduced amount of powder particles, to drop from the magnetic brush roll and into the sump. The ratio of powder particles to magnetic beads are maintained at a relative constant amount by well known concentration monitoring devices (not shown) of the type typically used in the electrophotography industry.

A metering blade 62 removes excess powder material 50 from the magnetic brush roll 54 and ensures an even depth of coverage with powder material before arrival at the loading nips 55. The donor rolls 56 have a resistive overcoating on each of their outer surfaces that provides dissipation of any charge accumulation thereon. An array of self-spaced AC biased wires 64 having a diameter of about 60 μm detaches the charged powder particles 51 from the electrically grounded donor rolls to generate a powder cloud 66 in the vicinity of the wires 64. The AC voltage from AC voltage source 65 relative to the donor rolls is typically a square wave having an amplitude of 600 to 800 volts peak-to-peak and a frequency of 10 kHz. A low DC voltage (not shown) can also be included with the AC applied to the wires to prevent powder particle accumulation on the wires. For negative charged powder particles, a negative DC potential up to approximately 100 volts reduces powder particle accumulation on the wires. For positive charged powder particles, a similar positive DC potential is advantageous.

For well-defined articles, such as, rolls and flat coil stock (not shown), the electrostatic coating apparatus can be positioned close to the articles, for example, up to a few millimeters away with the rolls or coil stock being moved past the electrostatic coating apparatus. For this situation, a DC electrical bias (not shown), in combination with an AC voltage that has an amplitude up to several kilovolts at a frequency of several kilohertz, may be applied between the coating apparatus 12 (In this case, the donor rolls are not electrically grounded.) and the article 16 to be coated to cause the charged powder particles to deposit on the article. This deposition process on uniform surfaces of articles, generally equally spaced from the coating apparatus, minimizes powder particle over spray from the powder cloud 66 that requires collection for reuse.

For irregular-shaped articles 16, such as I-beams and automobile and appliance components, the spacing between the coating apparatus and articles to be coated must be tens of centimeters to several meters. For this type of article to be coated, air jets 67 are positioned near the powder cloud 66 of AC fringe electric field detached powder particles 51, in order to transport the charged powder particles 51 closer to and surround the article to be coated. The electrostatic forces cause the deposition of the charged powder particles in the powder cloud 66 onto the exposed exterior surfaces of the irregular-shaped article 16. Generally, the article 16 to be coated is electrically grounded. Although primary reference is made to coating metallic objects that are held at ground potential, it is understood that a wide variety of substrates can be coated, including composites of carbon nanotubes/nanofibers and other conductive fibers in polymeric materials, wood, medium density fiberboard (MDF), etc.

Most of the powder particles 51 on the donor rolls 56 is removed by the AC fringe field detachment wires 64, so that the donor rolls must be reloaded in a single pass by the magnetic brush 54 having the powder material of magnetic beads and powder particles. To readily achieve this, the beads should be conductive in order to provide high-deposition electric fields.

Although FIG. 2 illustrates AC biased wires 64 as a preferred method of subjecting an AC fringe electric field to the layer of powder particles on the donor rolls 56, other fringe field generating configurations may be effective in detaching charged powder particles from donor rolls and generating a powder cloud. For example, the Scavengeless Electroded Donor Development system disclosed in U.S. Pat. No. 5,504,563 may be used in which an AC bias is applied between neighboring interdigitated electrodes (not shown) embedded in a rotating donor roll 56 or belt (not shown). Also, a stationary AC biased interdigitated electrode assembly positioned behind a moving thin dielectric donor belt (neither shown) may be used as disclosed in U.S. Pat. No. 5,276,488. The relevant portions of U.S. Pat. No. 5,504,563 and U.S. Pat. No. 5,276,488 are hereby incorporated by reference regarding the use of AC fringe fields to detach charged powder particles from donor rolls.

For triboelectric or ion spray guns used in the present powder coating industry, the maximum spraying rate per gun is about 600 gm/min. The powder coating apparatus of FIG. 2 achieves a maximum spraying rate of 600 gm/min with a powder particle coverage on the donor rolls 56 of 1 mg/cm$^2$, the length of each of the two donor rolls is 40 cm, and the surface speed of each donor roll is 125 cm/sec. For high powder particle throughput requirements, it may be necessary to increase the number of mixing augers 53 or to include a paddle wheel (not shown) in the sump 52 in order to provide adequate triboelectric charging of the powder particles. To circumvent the need to periodically replace aged magnetic beads, the replenishing powder particles can contain an optimum percentage of magnetic beads for the continual replacement of aged beads via a well-known technique of providing a trickle port (not shown) on the housing 30.

The typical charge-to-mass ratio of 30 to 40 μm electrostatic powder particles used in the powder coating industry is about 1 μC/gm. This level of charging is low compared to that used in electrophotography, even after scaling the ratio according to the inverse of the particle size (i.e., for 10 μm powder particles, the charge-to-mass ratio would be about 3 μC/gm). The maximum charge-to-mass ratio is limited by air breakdown within the deposited layer on the article to be coated. If finer powder particles enable thinner coatings, higher charge-to-mass ratios could be used without the air breakdown limitation that causes coating defects. For a breakdown field of about 10 V/μm, the maximum charge-to-mass ratio is about 5 μC/gm for about a 2 mg/cm$^2$ coverage of powder particles on the article. This charge-to-mass ratio can be obtained by selecting a coating material for the magnetic beads.

If magnetic bead carry out on the donor rolls 56 is excessive, permanent magnets 78 could be placed adjacent the donor rolls to collect the beads in a region above the loading nips 55 and a sufficient distance from the magnetic brush roll 54 to avoid picking up any beads therefrom.

Figure 3:
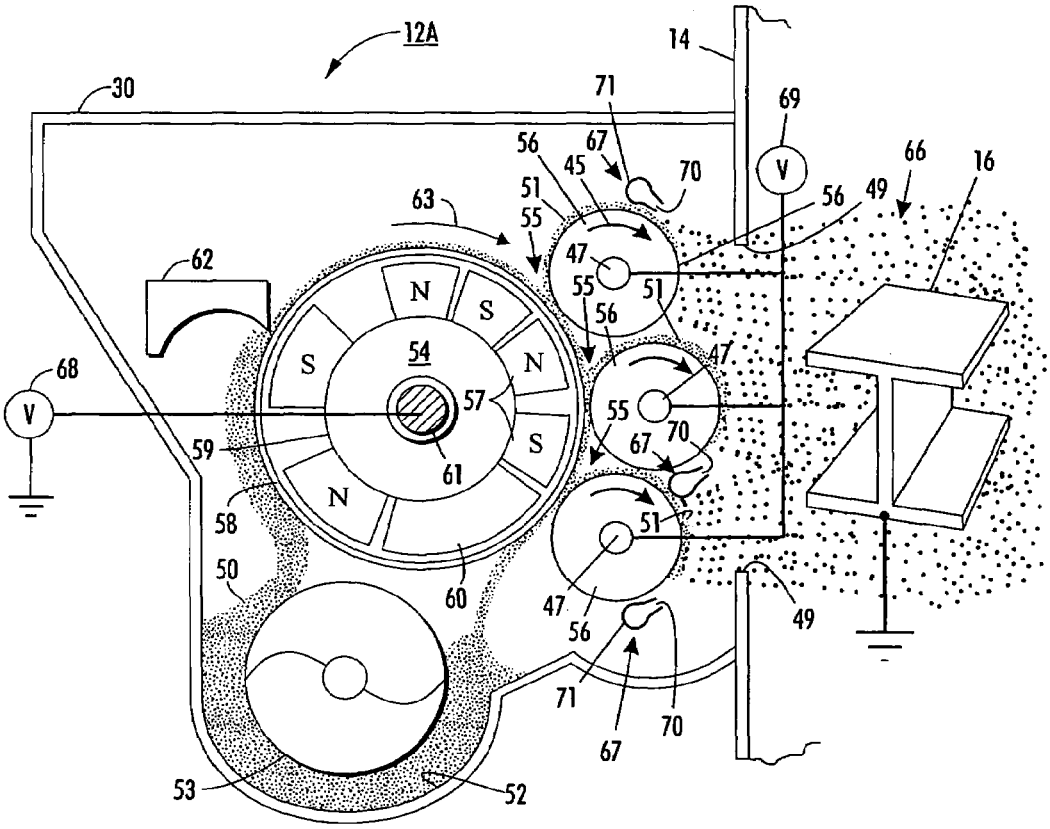
FIG. 3 is a schematic elevation view of another powder coating apparatus of this application shown in cross-section and similar to FIG. 2.

Referring to FIG. 3, another embodiment of the electrostatic powder coating apparatus 12A of this application is shown in a cross-sectional, schematic elevation view similar to that of FIG. 2. The electrostatic powder coating apparatus in FIG. 3 is substantially identical to that in FIG. 2, except there are more donor rolls 56 mounted for rotation about their respective axes 47 in the direction of arrows 45 than in the configuration shown in FIG. 2. In FIG. 3, there are three donor rolls shown. As in the previous embodiment, the donor rolls are in substantial tangential contact with the surface of the magnetic brush 54 to form respective loading nips 55. The donor rolls are adjacent and confront the aperture 49 that interconnects the interior of housing 30 with the interior of coating booth 14. The donor rolls are each either electrically grounded or biased by electrical voltage source 69, and each has a resistive overcoating that provides dissipation of any charge accumulation. An air jet 67 near each powder particle covered donor roll detaches the charged powder particles 51 from the donor roll in a direction through the aperture 49 and towards the article 16 to be coated. The air jets can be generated through a slot 70 or a linear array of apertures (not shown) in elongated tubular members 71 connected to a source of compressed air (not shown). The space-charge electric field from the powder cloud 66 generated by the air jets 67 promotes powder particle deposition onto the grounded article 16. The powder particles on the donor rolls are substantially totally removed by the air jets, so that they must be reloaded in a single pass by the magnetic brush containing the powder material comprised of magnetic beads and powder particles. This is readily accomplished if the magnetic beads are also electrically conducting to provide high deposition electric fields.

The maximum rate of charged powder particles generated by the electrostatic powder coating apparatus of FIG. 3 is about 900 gm/min, which is more than the maximum spraying rate of existing triboelectric or ion spay guns. To achieve this rate of charged powder particles generated by the embodiment in FIG. 3, the powder particle coverage on each of the donor rolls should be about 1 mg/cm$^2$. In addition, the length of each donor roll should be at least 40 cm, the minimum number of donor rolls should be three, and the surface speed of each donor roll should be 125 cm/sec. Again, for high powder particle throughput requirements, it may be necessary to increase the number of mixing augers 53 or to include a paddle wheel (not shown) for mixing in the sump 52 to provide adequate powder particle charging. Also, the replenishing powder material could contain an optimum percentage of magnetic beads for the continued replacement of aged beads by way of trickle port (not shown) in the housing 30. This technique is well known in the electrophotography field, and circumvents the need to periodically replace all of the aged magnetic beads in the powder material.

If magnetic bead carry out on the donor rolls 56 is excessive, permanent magnets (not shown) may be positioned adjacent the donor rolls in a region above the loading nips 55 and at a location sufficiently distanced from the magnetic brush roll 54, as described for the embodiment of FIG. 2, in order to collect the beads from the donor rolls.

Figure 4:
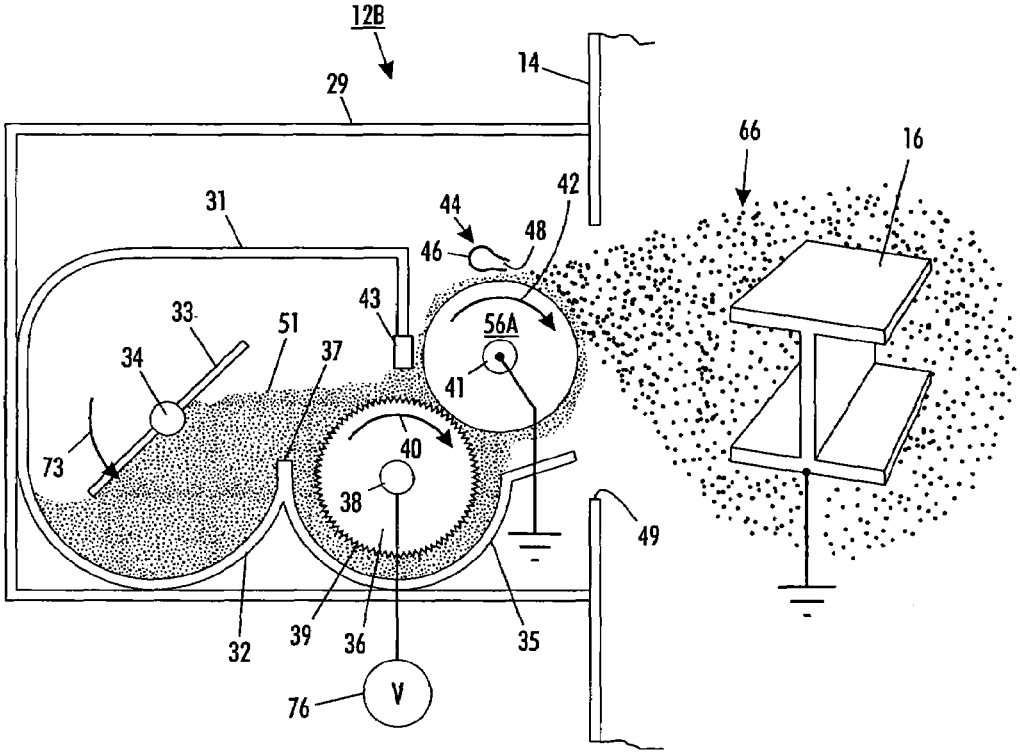
FIG. 4 is a schematic elevation view of still another powder coating apparatus of this application shown in cross-section and similar to FIG. 2.

In FIG. 4, a schematic elevation view of another embodiment of a powder coating apparatus of this application is shown in cross-section. In this embodiment, the powder coating apparatus 12B comprises a housing 29 having a chamber 31 therein containing a supply of powder particles 51, as a single component, in an arcuate lower section, as seen in cross-section, that is referred to as sump 32. The housing 29 is attached to the coating booth 14 with an aperture 49 therebetween. The powder particles range in size from about 4 to 40 μm in diameter and are preferably about 10 μm in average diameter. The sump 32 includes a rotatable paddle 33 that is fixedly mounted on shaft 34. The shaft is located at about the center of the paddle, and the paddle is rotated about shaft 34 in the direction of arrow 73 by any suitable means, such as, for example, an electric motor (not shown). The chamber also has a second arcuate lower section 35 that contains a rotatable, conformable paddle roll 36. The second lower section 35 is adjacent the sump 32 and the sump and second lower section have a common wall 37 that has a height selected to enable powder particles 51 to be urged from the sump into the second lower section 35 by the paddle 33.

The conformable paddle roll 36 is mounted on a shaft 38 and consists of any suitable compliant material, such as, for example, a conductive rubber. In the preferred embodiment, the paddle roll has a cylindrical shape with parallel grooves 39 in its outer surface, and the shaft 38 is axially located therein. The conformable paddle roll is positioned in contact with a rotatable donor roll 56A, and when the paddle roll is rotated about its shaft 38 in the direction of arrow 40, powder particles 51 are delivered in the grooves 39 to the donor roll 56A. The paddle shaft 34, the paddle roll shaft 38, and donor roll shaft 41 are parallel to each other. The donor roll is rotated about its shaft 41 in the same direction as the paddle roll, as shown by arrow 42. The paddle roll 36 and donor roll 56A may be rotated individually or together by any suitable means, such as, for example, an electric motor (not shown).

An electrical bias is applied to the paddle roll by voltage source 76 to control the charging polarity and magnitude of the charged powder particles 51 deposited on the electrically grounded donor roll 56A. The paddle roll is rotated at a different speed than the donor roll. The differential speed is used for the paddle roll in order to promote the loading of the powder particles onto the donor roll. Though the paddle roll is shown as being rotated in the same direction as the donor roll, the paddle roll may be rotated either with or against the direction of the donor roll.

A flexible metering blade 43 is loaded against the donor roll 56A to meter the powder particles 51 on the donor roll and provide a uniform layer thereon. The metering blade also provides additional triboelectrical charging of the powder particles. The amount of metering of the powder particles on the donor roll is controlled by the degree of extension of the metering blade beyond the contact line of the metering blade with the surface of the donor roll. A greater extension provides a thicker powder particle layer. If the flexible metering blade is made conducting, an electrical bias (not shown) can be applied to the metering blade to assist in obtaining the desired level of powder particle charging. Therefore, the metering blade is made conducting in the preferred embodiment.

The donor roll 56A has a resistive overcoat layer (not shown) on its outer surface that provides dissipation of any charge accumulation. An air jet 44 near the powder-particle covered donor roll 56A detaches the charged powder particles 51 from the donor roll and produces a powder cloud 66. The air jet directs the powder cloud 66 through the aperture 49, located between the housing 29 and coating booth 14, and towards the article 16 to be coated. The air jet 44 is generated along the length of the donor roll from an elongated tubular member 46 that is parallel to the donor roll. The tubular member may have a long narrow slot 48 or a linear plurality of small apertures (not shown) in the elongated tubular member 46. A typical compressed air source (not shown) is connected to one end of the tubular member 46, and the compressed air is regulated by well known means (not shown) to provide the desired air jet velocity for detaching the charged powder particles.

The space-charge electric field from the powder cloud 66 of charged powder particles 51 promotes powder particle deposition onto the grounded article 16 to be coated. Since essentially all of the powder particles on the donor roll 56A is removed by the air jet 44, the donor roll is reloaded in a single pass by paddle roll 36 and metering blade 43.

For the powder coating apparatus 12B illustrated in FIG. 4, it is estimated that a maximum rate of charged powder particles delivered from the donor roll is about 300 gm/min. For this delivery rate, the powder particle coverage on the donor roll is 1 mg/cm$^2$, the length of the donor roll is 40 cm, and the surface speed of the donor roll is 125 cm/sec. If a higher delivery rate is desired, multiple powder coating apparatuses can be ganged together.

The maximum charge-to-mass ratio is limited by air breakdown within the deposited layer of powder particles on the article 16. The typical charge-to-mass ratio of 30 to 40 μm electrostatic powder particles used in the powder coating industry is about 1 μC/gm. For powder particles having an average diameter of 10 μm, the charge-to-mass ratio is about 3 μC/gm. If finer powder particles enable thinner coatings, higher charge-to-mass ratios could be used without the air breakdown limitation that causes coating defects. For a breakdown field of about 10 V/μm, the maximum charge-to-mass ratio is about 5 μC/gm for about a 2 mg/cm$^2$ coverage of powder particles on the surface of the article. This charge-to-mass ratio can be readily obtained by material choices for the paddle roll, donor roll, and metering blade.

The exemplary embodiments described above for powder particle coating apparatus has one major advantage over the prior art. These embodiments eliminate the need for fluidization of the powder particles, so that finer powder particle may be used to coat irregular, three-dimensional articles with thinner coats.

Although the foregoing description illustrates the preferred embodiment, other variations are possible and all such variations as will be apparent to those skilled in the art are intended to be included within the scope of this application as defined by the following claims.

What is claimed is:

1. A process for electrostatic powder coating of an article, comprising the steps of:

triboelectrically charging powder particles contained in a chamber, said powder particles having an average diameter of about 10 μm combining said triboelectrically charged powder particles with magnetic beads in said chamber, said charged powder particles being electrostatically attracted to said magnetic beads;

providing a magnetic brush roll;

advancing said combined magnetic beads and charged powder particles attracted thereto by said magnetic brush roll from said chamber to a loading nip formed between said magnetic brush roll and at least one rotatable donor roll;

metering said combined magnetic beads and charged powder particles being advanced by said magnetic brush roll to provide a uniform layer thereon;

rotating said at least one donor roll past said loading nip and a location for detaching said charged powder particles therefrom;

extracting said charged powder particles from said magnetic beads on said magnetic brush roll at said loading nip and depositing said charged powder particles onto said at least one donor roll;

detaching said charged powder particles from the at least one donor roll by a plurality of wires having an AC bias applied thereto, said wires being adjacent said at least one donor roll at said location for detaching said charged powder particles, said charged powder particles detached from said at least one donor roll by said AC biased wires forming a powder cloud in the vicinity of said AC biased wires;

directing said cloud of charged powder particles toward an article to be coated by an air jet; and grounding said article, so that said charged powder particles are attracted to and coat said article.

2. The process as claimed in claim 1, wherein the step of triboelectrically charging powder particles is accomplished by providing at least one auger in said chamber.

3. A process for electrostatic powder coating of an article comprising the steps of:

triboelectrically charging powder particles contained in a chamber, said powder particles having an average diameter of about 10 μm combining said triboelectrically charged powder particles with magnetic beads in said chamber, said charged powder particles being electrostatically attracted to said magnetic beads;

providing a magnetic brush roll;

advancing said combined magnetic beads and charged powder particles attracted thereto by said magnetic brush roll from said chamber to a loading nip formed between said magnetic brush roll and at least one rotatable donor roll;

metering said combined magnetic beads and charged powder particles being advanced by said magnetic brush roll to provide a uniform layer thereon;

rotating said at least one donor roll past said loading nip and a location for detaching said charged powder particles therefrom;

electrically biasing said at least one donor roll;

using the electrical bias of said at least one donor roll to extract said powder particles from said magnetic beads on said magnetic brush roll at said loading nip and to deposit said charged powder particles onto said at least one donor roll;

detaching said charged powder particles from said at least one donor roll by an air jet near said at least one donor roll and at said location for detaching, said air jet detaching said charged powder particles from said at least one donor roll to form both a powder cloud thereby and to direct said powder cloud to an article to be coated; and grounding said article, so that said charged powder particles are attracted to and coat said article.

4. A process for electrostatic powder coating of an article, comprising the steps of:

triboelectrically charging powder particles contained in a chamber, said powder particles having an average diameter of about 10 μm;

advancing said charged powder particles from said chamber onto at least one donor roll by providing a rotatable paddle roll in said chamber and in contact with said at least one donor roll;

rotating said paddle roll and said at least one donor roll;

metering said charged powder particles on said at least one donor roll to provide a uniform layer of powder particles thereon;

detaching said charged powder particles from said at least one donor roll by means including an air let and forming a cloud of charged powder particles;

directing said cloud of charged powder particles toward an article to be coated by said air jet; and grounding said article, so that said charged powder particles are attracted to and coat said article.

5. The process as claimed in claim 4, wherein the process further comprises the steps of:

constructing said paddle roll from a suitable compliant material having a cylindrical shape; and providing a plurality of parallel grooves in an outer surface of the paddle roll, so that the grooves may carry said charged powder particles onto said at least one donor roll.

6. The process as claimed in claim 5, wherein the process further comprises the step of:

electrically biasing said paddle roll to control the charging polarity and magnitude of said charged powder particles; and wherein said metering of said charged powder particles is accomplished by providing a metering blade loaded against said at least one donor roll, said metering blade providing additional triboelectrical charging of said charged powder particles.

7. The process as claimed in claim 6, wherein the process further comprises the step of:

controlling the thickness of said uniform layer of charged powder particles on said at least one donor roll by the degree of extension of said metering blade beyond a line of contact of said metering blade with said at least one donor roll.

8. The process as claimed in claim 7, wherein the process further comprises the step of:

providing a resistive overcoat layer on said at least one donor roll to dissipate any charge accumulation thereon.

* * * * *